US008851772B2

(12) United States Patent
Gouda et al.

(10) Patent No.: US 8,851,772 B2
(45) Date of Patent: Oct. 7, 2014

(54) PRINTING APPARATUS AND FEEDING CONTROL METHOD

(75) Inventors: Mitsunobu Gouda, Ibaraki (JP); Katsumi Ishizawa, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 92 days.

(21) Appl. No.: 13/611,418

(22) Filed: Sep. 12, 2012

(65) Prior Publication Data

US 2013/0071169 A1 Mar. 21, 2013

(30) Foreign Application Priority Data

Sep. 16, 2011 (JP) ..... 2011-203189
May 31, 2012 (JP) ..... 2012-125337

(51) Int. Cl.

*B41J 11/00* (2006.01)
*B41J 15/00* (2006.01)
*G03G 15/00* (2006.01)
*B41J 11/42* (2006.01)

(52) U.S. Cl.

CPC ..... *B41J 11/42* (2013.01); *G03G 15/652* (2013.01); *B41J 15/005* (2013.01)
USPC ..... 400/583; 400/611; 400/618; 399/329

(58) Field of Classification Search

USPC ..... 399/122, 322, 329, 67, 68; 400/583, 400/611, 618; 226/195, 122
See application file for complete search history.

(56) References Cited

U.S. PATENT DOCUMENTS 5,491,545 A * 2/1996 Kopp et al. ..... 399/322
5,752,153 A * 5/1998 Kreiter et al. ..... 399/384
6,298,216 B1 10/2001 McMindes et al.
6,684,051 B2 * 1/2004 Miyamoto et al. ..... 399/384
2003/0039496 A1 2/2003 Miyamoto et al.
2005/0184119 A1 8/2005 Ohmura et al.
2011/0064468 A1 3/2011 Kawahata et al.
2011/0176851 A1 7/2011 Kuwana et al.

FOREIGN PATENT DOCUMENTS

JP 58-072976 5/1983
JP 64-019585 1/1989
JP 06-007290 1/1994
JP 2576192 11/1996
JP 2001-194944 7/2001
JP 2002-055561 2/2002
JP 2003-136793 5/2003
JP 2005-077650 3/2005
JP 2005-215427 8/2005

(Continued)

*Primary Examiner* — Matthew G Marini

(74) *Attorney, Agent, or Firm* — Oblon, Spivak, McClelland, Maier & Neustadt, L.L.P.

(57) ABSTRACT

According to the embodiment, a printing apparatus includes: a printing unit that forms an image on a web; a first feeding unit that feeds the web; a second feeding unit downstream of the printing unit in a feed direction; a buffer unit that has a buffer plate and absorbs flexure of the web generated by the two feeding units by operating the buffer plate; a first feeding control unit that causes the first feeding unit to execute a first deceleration operation; and a second feeding control unit that causes the second feeding unit to execute the first deceleration operation when a trigger for stopping the feed of the web has occurred, measures a feed amount of the web fed by the second feeding unit, and changes the first deceleration operation to a second deceleration operation based on the feed amount.

9 Claims, 8 Drawing Sheets

(56) References Cited

FOREIGN PATENT DOCUMENTS

| | | |
|---|---|---|
| JP | 2007-055791 | 3/2007 |
| JP | 2007-156315 | 6/2007 |
| JP | 2007-316411 | 12/2007 |
| JP | 2009-294481 | 12/2009 |
| JP | 2010-083677 | 4/2010 |
| JP | 2011-059635 | 3/2011 |
| JP | 2011-170324 | 9/2011 |

* cited by examiner

PRINTING APPARATUS AND FEEDING CONTROL METHOD

CROSS-REFERENCE TO RELATED APPLICATIONS

The present application claims priority to and incorporates by reference the entire contents of Japanese Patent Application No. 2011-203189 filed in Japan on Sep. 16, 2011 and Japanese Patent Application No. 2012-125337 filed in Japan on May 31, 2012.

BACKGROUND OF THE INVENTION

1. Field of the Invention

The invention relates to a printing apparatus and a feeding control method.

2. Description of the Related Art

In a printing apparatus for printing an image on a web (for example, a roll sheet), although the web is fed by two feeding units, i.e., a printing feeding unit and a fixing feeding unit, since the printing feeding unit and the fixing feeding unit have a different driving source respectively, a difference occurs in web feed amounts by the two driving sources. To cope with the problem, the printing apparatus interposes a buffer unit having a buffer plate which generates reaction force in a direction and makes a circular arc motion between the printing feeding unit and the fixing feeding unit; and the difference between the web feed amounts is absorbed by changing an angle of the buffer plate.

When the angle of the buffer plate exceeds a predetermined range, there is a possibility that the web is break off, whereas when the angle of the buffer plate becomes smaller than the predetermined range, there is a possibility that the web is defectively fed due to an insufficient amount of tension. Accordingly, in the printing apparatus, it is necessary to control a feed of the web so that the angle of buffer plate falls within a predetermined range.

However, it is necessary for the printing feeding unit to feed the web so that a toner image is transferred to a determined position of the web in a printing unit. Accordingly, in the printing apparatus, ordinarily, the fixing feeding unit feeds the web so that the angle of buffer plate falls within the predetermined range.

When the feed of the web is stopped, it is necessary for the fixing feeding unit to generate brake force so that the feed of the web is stopped in a state that the angle of the buffer plate falls within the predetermined range, therefore, an optimum value of the brake force to be generated is different depending on a friction load of the web to the fixing feeding unit and a load of the web (sheet).

For example, Japanese Patent Application Laid-open No. 2011-170324 discloses a technology for determining brake force that is used to stop a feed of a web next time from a buffer amount of a buffer plate when the feed of the web is stopped.

For example, Japanese Patent Application Laid-open No. 2007-316411 discloses a technology for adjusting brake force based on a change of a feed amount of a web per each minute unit time when a feed of the web is decelerated.

Further, for example, Japanese Patent Application Laid-open No. 61-098373 discloses a technology for detecting a cycle of generation of encoder pulses generated by a rotation of a driving source; determining brake force according to the detected cycle of generation of the encoder pulses; generating the determined brake force; and decelerating and stopping a feed of a web.

However, in the technology disclosed in Japanese Patent Application Laid-open No. 2011-170324, since it is at the time when the feed of the web is stopped next time that optimum brake force is reflected, there is a possibility that the buffer plate cannot be stopped in an appropriate range at the time when for example the web is replaced and the like.

In the technology disclosed in Japanese Patent Application Laid-open No. 2007-316411, since there is a case in which it is difficult to identify the change of the feed amount per each minute unit time in a case in which the web is likely to stop and in a case the web is not likely to stop, there is a possibility that the buffer plate cannot be stopped in an appropriate range.

Further, in the technology disclosed in Japanese Patent Application Laid-open No. 61-098373, when, for example, a difference exists between loads of webs, there is a possibility that the buffer plate cannot be stopped in an appropriate range.

There is a need to provide a printing apparatus and a feeding control method capable of causing an angle of a buffer plate to be fallen within an appropriate range without depending on a type of a web.

SUMMARY OF THE INVENTION

It is an object of the present invention to at least partially solve the problems in the conventional technology.

According to one embodiment, a printing apparatus includes: a printing unit that forms an image on a web; a first feeding unit that feeds the web in the printing unit; a second feeding unit that feeds the web downstream of the printing unit in a feed direction; a buffer unit that has a buffer plate and absorbs flexure of the web generated by a feed difference between the first feeding unit and the second feeding unit by operating the buffer plate; a first feeding control unit that causes the first feeding unit to execute a deceleration operation for decelerating a feed speed of the web when a trigger for stopping the feed of the web has occurred; and a second feeding control unit that causes the second feeding unit to execute a first deceleration operation for decelerating the feed speed of the web when the trigger for stopping the feed of the web has occurred, measures a feed amount of the web fed by the second feeding unit during a period until a predetermined time passes, and changes the first deceleration operation executed by the second feeding unit to a second deceleration operation based on the feed amount.

According to another embodiment, feeding control method is provided executed in a printing apparatus. The printing apparatus includes: a printing unit that forms an image on a web; a first feeding unit that feeds the web in the printing unit; a second feeding unit that feeds the web downstream of the printing unit in a feed direction; and a buffer unit that has a buffer plate and absorbs flexure of the web generated by a feed difference between the first feeding unit and the second feeding unit by operating the buffer plate. The feeding control method includes: first feeding controlling that causes, when a trigger for stopping the feed of the web has occurred, by a first feeding control unit, the first feeding unit to execute a deceleration operation for decelerating a feed speed of the web; and a second feeding controlling that causes, when the trigger for stopping the feed of the web has occurred, by a second feeding control unit, the second feeding unit to execute a first deceleration operation for decelerating the feed speed of the web, measures a feed amount of the web fed by the second feeding unit during a period until a predetermined time passes, and changes the first deceleration operation executed by the second feeding unit to a second deceleration operation based on the feed amount.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

An embodiment of a printing apparatus and a feeding control method will be explained below in detail referring to attached drawings.

Figure 1:
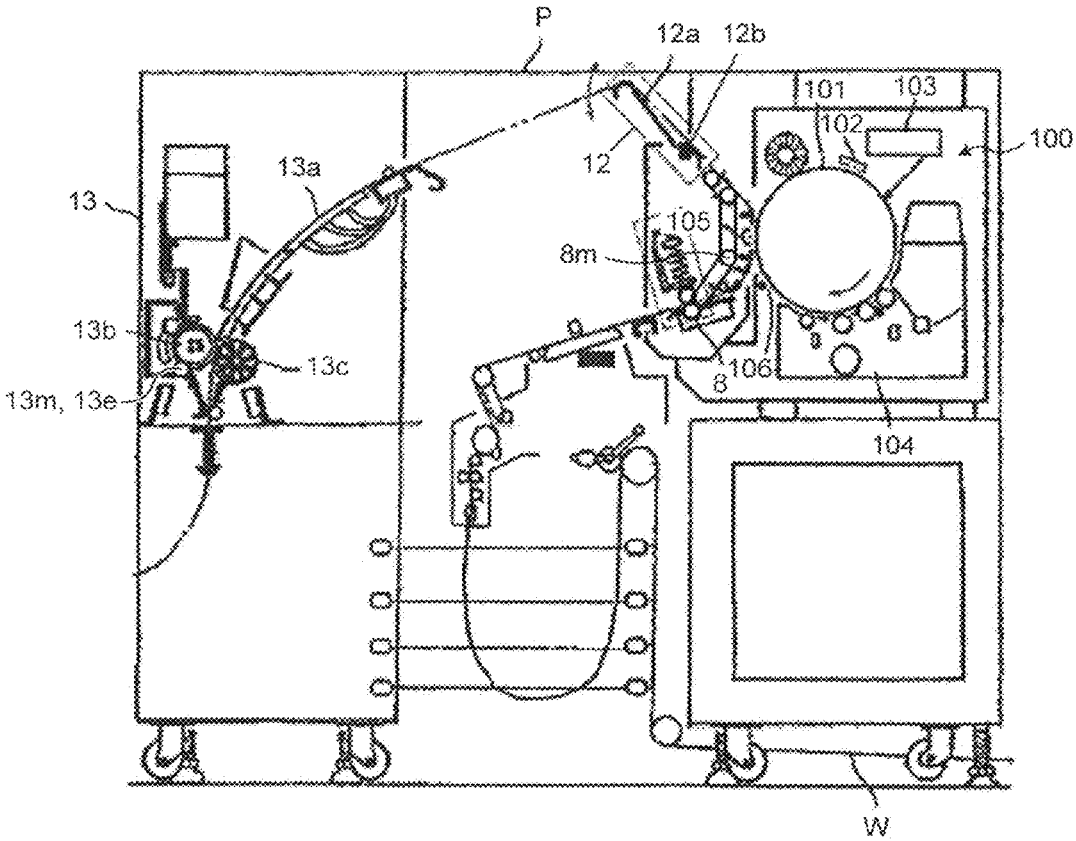
FIG. 1 is a schematic view illustrating an example of a mechanical configuration of a printing apparatus of an embodiment.

FIG. 1 is a schematic view illustrating an example of a mechanical configuration of the printing apparatus P of the embodiment. As illustrated in FIG. 1, the printing apparatus P includes a printing unit 100, a printing feeding unit 8 (an example of a first feeding unit), a fixing feeding unit 13 (an example of a second feeding unit), and a buffer unit 12.

The printing unit 100 forms a toner image to a web W. The printing unit 100 has a photosensitive drum 101, a charging unit 102, an exposing device 103, a developing device 104, a transferring device 105, and a toner adhesion amount sensor 106. Note that the web W may be assumed to be a roll sheet in the embodiment, the web W is not limited to the roll sheet type. Further, in the embodiment, although the printing unit 100 of the printing apparatus P will be explained as to a configuration employing an electrophotography, the printing unit 100 is not limited thereto and may be, for example, a configuration employing an ink (liquid droplet) injection system by an inkjet system (for example, a line-type head). Even in a printing configuration employing the inkjet system, the configuration of the embodiment can be applied as the fixing feeding unit 13 which fixes ink on a web by subjecting the ink on a web surface to a heating/pressurizing treatment.

The photosensitive drum 101 is driven in rotation. The charging unit 102 charges the photosensitive drum 101. The exposure device 103 projects an exposure pattern based on print data to the photosensitive drum 101. With the operation, an electrostatic latent image is formed on the photosensitive drum 101. The developing device 104 develops the electrostatic latent image formed on the photosensitive drum 101. With the operation, a toner image is formed on the photosensitive drum 101. The transferring device 105 transfers the toner image formed on the photosensitive drum 101 onto the web W fed by the printing feeding unit 8. Note that a forming condition for forming the toner image is corrected according to an output of the toner adhesion amount sensor 106.

The printing feeding unit 8 feeds the web W in the printing unit 100. The printing feeding unit 8 has a web feeding motor 8*m* and feeds the web W in such a manner that the web feeding motor 8*m* drives feed rollers disposed upstream and downstream of the transferring device 105 via a transmission drive system.

The fixing feeding unit 13 feeds the web W and fixes the toner image formed on the web W. The fixing feeding unit 13 has a heat roll motor 13*m* (an example of a DC servo motor), a heat roll 13*b*, a preheater 13*a*, a pressing roller 13*c*, and an encoder 13*e*. The fixing feeding unit 13 feeds the web W in such a manner that the heat roll motor 13*m* drives the heat roll 13*b* in which a heater is built in via a transmission drive system. The preheater 13*a* causes the web W on which the toner image is formed to come into intimate contact therewith by negative pressure suction and heats the web W to a temperature near to a transition temperature of a toner resin. The heat roll 13*b* and the pressing roller 13*c* melt the toner image formed on the web W and fix the toner image to the web W. The encoder 13*e* detects a rotation of the heat roll motor 13*m* and outputs a pulse.

As described above, in the printing apparatus P of the embodiment, although the printing feeding unit 8 and the fixing feeding unit 13 feed the web W, since the printing feeding unit 8 and the fixing feeding unit 13 have a different driving source (the web feeding motor 8*m* is used in the printing feeding unit 8, and the heat roll motor 13*m* is used in the fixing feeding unit 13) respectively, a difference is caused between feed amounts of the web W.

The buffer unit 12 is interposed between the printing feeding unit 8 and the fixing feeding unit 13. The buffer unit 12 has a buffer plate 12*a* for generating reaction force in a direction and executing a circular arc motion and a buffer amount sensor 12*b* for detecting an angle of the buffer plate 12*a*. The buffer unit 12 operates the buffer plate 12*a* and absorbs flexure of the web W generated by a difference of feed between the printing feeding unit 8 and the fixing feeding unit 13.

When the angle of the buffer plate 12*a* makes the circular arc motion within a predetermined range, the web W can be held in a state in which a predetermined amount of tension is applied thereto. When the angle of the buffer plate 12*a* exceeds the predetermined range, however, there is a possibility that the web W is cut off, whereas when the angle of the buffer plate 12*a* becomes smaller than the predetermined range, there is a possibility that the web W is defectively fed due to an insufficient amount of tension. Thus, in the printing apparatus P of the embodiment, the feed of the web is controlled so that the angle of the buffer plate 12*a* falls within the predetermined range.

Figure 2:
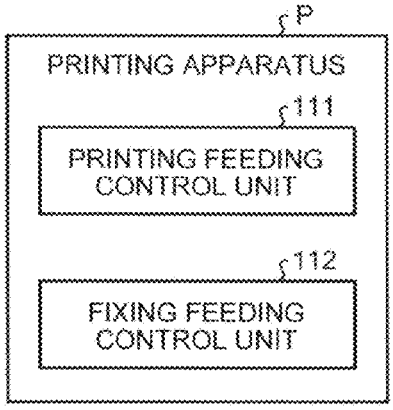
FIG. 2 is a block diagram illustrating an example of a functional configuration of the printing apparatus of the embodiment.

FIG. 2 is a block diagram illustrating an example of a functional configuration of the printing apparatus P of the embodiment. As illustrated in FIG. 2, the printing apparatus P includes a printing feeding control unit 111 (an example of a first feeding control unit) and a fixing feeding control unit 112 (an example of a second feeding control unit).

The printing feeding control unit 111 controls the printing feeding unit 8. When, for example, a trigger for stopping the feed of the web W has occurred, the printing feeding control unit 111 causes the printing feeding unit 8 to execute a deceleration operation for decelerating a feed speed of the web W. Here the trigger is a time, case, situation, condition, or signal for the apparatus to stop feeding, which is generally indicated and transmitted by signal. In the printing feeding unit 8, it is necessary for the printing unit 100 to feed the web W so that the toner image is transferred to a determined position of the web W. Accordingly, when the web W is fed, the printing feeding control unit 111 controls an amount of rotation of the web feeding motor 8*m* per unit time to a predetermined amount. As a result, the feed amount of the web W in the printing feeding unit 8 becomes constant regardless of a material (type) of the web W. Note that, in any of a case in which the web W is fed while being accelerated, a case in which the web W is fed at a constant speed, and a case in which the web W is fed while being decelerated, the printing feeding control unit 111 controls the amount of rotation per unit time of the web feeding motor 8*m*.

The fixing feeding control unit 112 controls the fixing feeding unit 13. Specifically, the fixing feeding control unit 112 controls a rotation speed of the heat roll motor 13*m* so that the angle of the buffer plate 12*a* detected by the buffer amount sensor 12*b* while the web W is being fed falls within the predetermined range.

When, for example, the feed speed of the web W is decelerated, the fixing feeding control unit 112 causes the heat roll motor 13*m* to generate brake force so that the angle of the buffer plate 12*a* falls within the predetermined range. In the embodiment, the fixing feeding control unit 112 decelerates the feed speed of the web W by decelerating the rotation of the heat roll motor 13*m* by causing a brake current to periodically flow to the heat roll motor 13*m*. Note that when, for example, the heat roll motor 13*m* rotates clockwise at the time the web W is fed at the constant speed, the brake current is a current for rotating the heat roll motor 13*m* counterclockwise.

However, an optimum value of the brake force (brake current) is different depending on a friction load of the web W and a load of the web (sheet), i.e., depending on the material (type) of the web W to the fixing feeding unit 13 (the preheater 13*a*). Accordingly, when the brake force (brake current), which is generated to the fixing feeding unit 13 at the time the feed of the web W is stopped, is fixed regardless of the type of the web W, the angle of the buffer plate 12*a* may not be fallen within the predetermined range.

Figure 3:
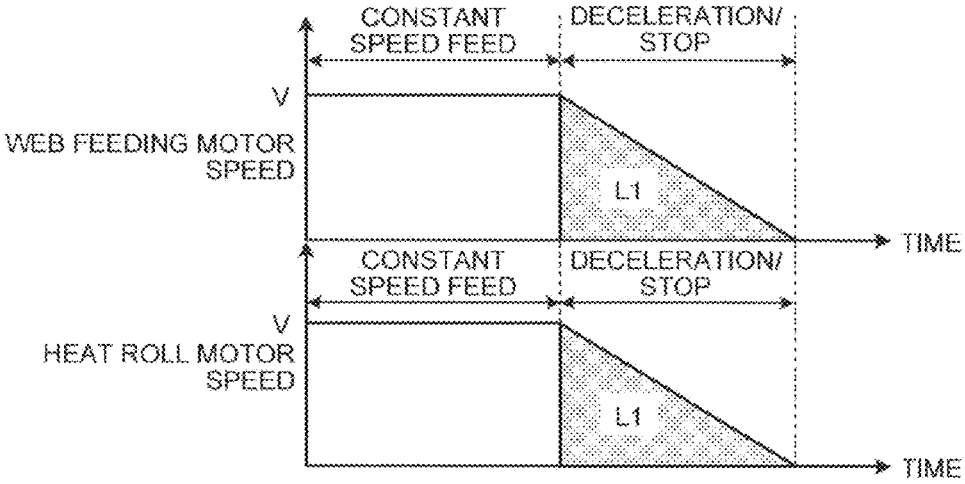
FIG. 3 is an explanatory view illustrating an example of a feed amount of a web as a general purpose sheet fed by a printing feeding unit and a fixing feeding unit when a feed of the web is stopped.
Figure 4:
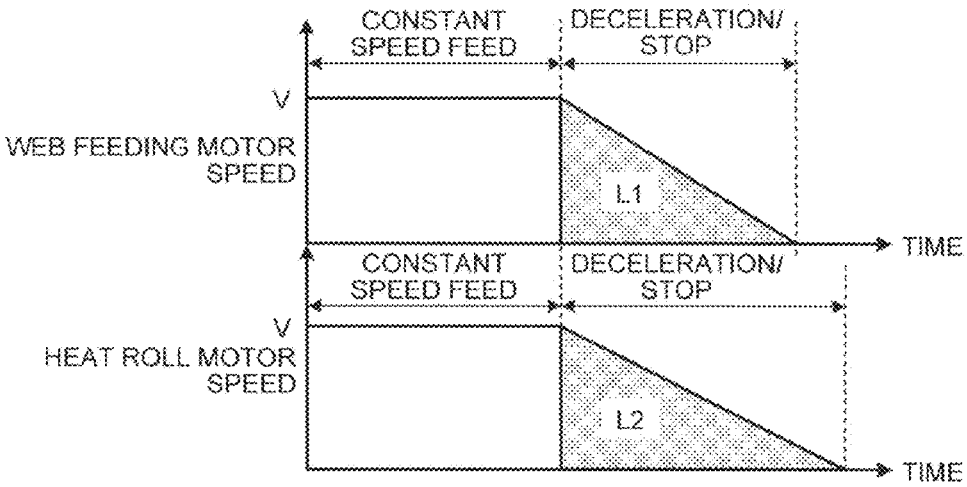
FIG. 4 is an explanatory view illustrating an example of a feed amount of a web as a coating sheet fed by the printing feeding unit and the fixing feeding unit when a feed of the web is stopped.
Figure 5:
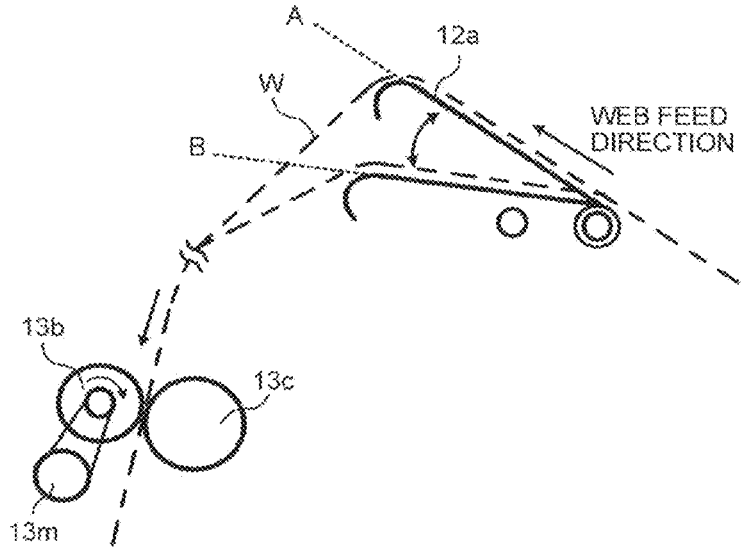
FIG. 5 is an explanatory view illustrating an example of an angle of a buffer plate after the feed of the web is stopped.

FIG. 3 is an explanatory view illustrating an example of the feed amount of the web W acting as a general purpose sheet and fed by the printing feeding unit 8 and the fixing feeding unit 13 when the feed of the web W is stopped, and FIG. 4 is an explanatory view illustrating an example of the feed amount of the web W acting as a coating sheet and fed by the printing feeding unit 8 and the fixing feeding unit 13 when the feed of the web W is stopped. In the examples illustrated in FIGS. 3 and 4, it is assumed that the brake force (brake current) generated to the fixing feeding unit 13 is set to the same value. FIG. 5 is an explanatory view illustrating an example of the angle of the buffer plate 12*a* after the feed of the web W has been stopped in FIGS. 3 and 4.

When the web W is the general purpose sheet, as illustrated in FIG. 3, a feed amount L1 of the web W fed by the printing feeding unit 8 (a brake distance of the web feeding motor 8*m*) agrees with a feed amount L1 of the web W fed by the fixing feeding unit 13 (a brake distance of the heat roll motor 13*m*). As a result, as illustrated in FIG. 5, the angle of the buffer plate 12*a* becomes A and the angle of the buffer plate 12*a* falls within the predetermined range.

In contrast, when the web W is the coating sheet, as illustrated in FIG. 4, a feed amount L2 of the web W fed by the fixing feeding unit 13 (the brake distance of the heat roll motor 13*m*) becomes larger than the feed amount L1 of the web W fed by the printing feeding unit 8 (the brake distance of the web feeding motor 8*m*). This is because the coating sheet has a larger degree of sheet smoothness and a smaller friction load than those of the general purpose sheet. As a result, as illustrated in FIG. 5, since the angle of the buffer plate 12*a* becomes B, there is a possibility that the angle of the buffer plate 12*a* may not be fallen within the predetermined range.

In an actual operation, although the feed of the web W is stopped once before the angle of the buffer plate 12*a* exceeds the predetermined range, a recovery operation is executed so that the angle of the buffer plate 12*a* becomes an optimum angle, and the feed of the web W is resumed, a throughput is reduced when the operation is executed.

In the embodiment, to make the angle of the buffer plate 12*a* fall within an appropriate range without depending on the type of the web W, when the trigger for stopping the feed of the web W has occurred, the fixing feeding control unit 112 causes the fixing feeding unit 13 to execute a first deceleration operation for decelerating the feed speed of the web W and measures the feed amount of the web W fed by the fixing feeding unit 13 until a predetermined time has passed. The fixing feeding control unit 112 changes the first deceleration operation executed by the fixing feeding unit 13 to a second deceleration operation based on the measured feed amount.

Specifically, the second deceleration operation is an operation for decelerating the feed speed of the web W more than the first deceleration operation, and when the measured feed amount is larger than a threshold value, the fixing feeding control unit 112 changes the first deceleration operation executed by the fixing feeding unit 13 to the second deceleration operation. Note that the fixing feeding control unit 112 measures a number of pulses output from an encoder 13*e* as the feed amount of the web W fed by the fixing feeding unit 13.

That is, in the embodiment, attention is paid to that the feed amount (a speed change) of the web W after the fixing feeding unit 13 has been caused to execute the first deceleration operation is different depending on the type of the web W, and when the feed amount of the web W fed by the first deceleration operation is larger than the threshold value and it is necessary to more decelerate the feed speed, the fixing feeding unit 13 is caused to execute the second deceleration operation according to the feed amount of the web W fed by the first deceleration operation.

Figure 6:
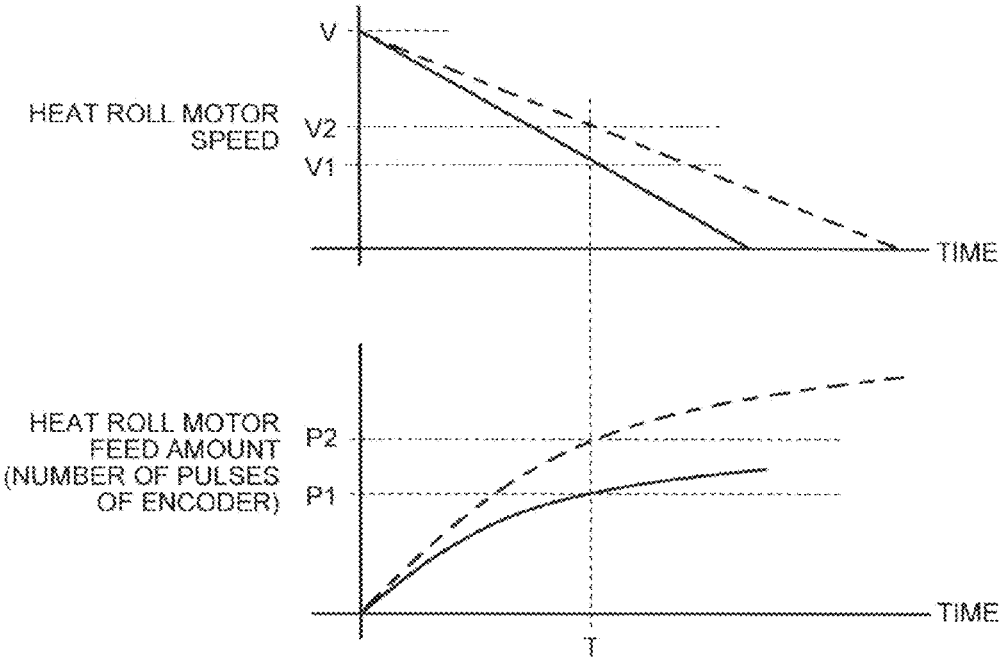
FIG. 6 is an explanatory view illustrating an example of a feed speed and a feed amount of each type of a web fed by the fixing feeding unit when the feed of the web is stopped.

FIG. 6 is an explanatory view illustrating an example of the feed speed and the feed amount of each type of the web W fed by the fixing feeding unit 13 when the feed of the web W is stopped. In the example illustrated in FIG. 6, it is assumed that the general purpose sheet (solid line) and the coating sheet (single-dashed line) are used as the type of the web W. Further, in the example illustrated in FIG. 6, it is assumed that the brake force (the brake current) generated to the fixing feeding unit 13 has the same value in the general purpose sheet and in the coating sheet and is not changed until the feed of the web W is stopped.

In FIG. 6, a time T illustrates a predetermined time. Although the time T is a value previously determined by experiment and set to 50 ms here, the time T is not limited thereto. As illustrated in FIG. 6, the feed amount of the web W, which is fed by the fixing feeding unit 13 (the heat roll motor 13*m*) until the time T passed after the trigger for stopping the feed of the web W had occurred, occupies about 70% of the feed amount of the web W, which is fed by the fixing feeding unit 13 (the heat roll motor 13*m*) until the feed of the web W has been stopped after the trigger for stopping the feed of the web W had occurred even if the web W is any of the general purpose sheet and the coating sheet. The feed amount of the web W until the time T has passed is approximately proportional to the feed amount of the web W until the feed of the web W has been stopped. Accordingly, the fixing feeding control unit 112 can determine whether or not the brake force (the brake current) generated to the fixing feeding unit 13 is sufficient from the feed amount of the web W until the time T has passed.

For example, as illustrated in FIG. 6, it is assumed that when the trigger for stopping the feed of the web W has occurred (when the web W has been fed at the constant speed), the feed speed of the web W fed by the fixing feeding unit 13 (the heat roll motor 13*m*) is V (inch/second). Further, it is assumed that the feed speed of the web W at the time T becomes V1 (inch/second) in the general purpose sheet and becomes V2 (inch/second) in the coating sheet as a result that the fixing feeding control unit 112 has caused the fixing feeding unit 13 to execute the deceleration operation (as a result of generation of the brake force).

In the case, the feed amount of the web W (inch) at the time T becomes $((V+V1)/2)\times T$ in the general purpose sheet and becomes $((V+V2)/2)\times T$ in the coating sheet. When a resolution of the encoder 13*e* (a number of pulses of the encoder when the web W is fed 1 inch) is illustrated by P and the feed amount of the web W is converted to the number of pulses of the encoder, the number of pulses in the general purpose sheet is illustrated by $P1=P\times((V+V1)/2)\times T$ and the number of pulses in the coating sheet is illustrated by $P2=P\times((V+V2)/2)\times T$. Since the feed speed of the web W at the time T is $V1<V2$, $P1<P2$ is established.

In the embodiment, as explained in FIG. 6, the fixing feeding control unit 112 measures the number of pulses until the time T has passed as the feed amount of the web W until the time T has passed and compares the measured number of pulses with a threshold value. When the measured number of pulses is larger than the threshold value and the brake force (brake current) generated to the fixing feeding unit 13 is not sufficient, the fixing feeding control unit 112 increases the brake force (brake current) generated to the fixing feeding unit 13.

Figure 7:
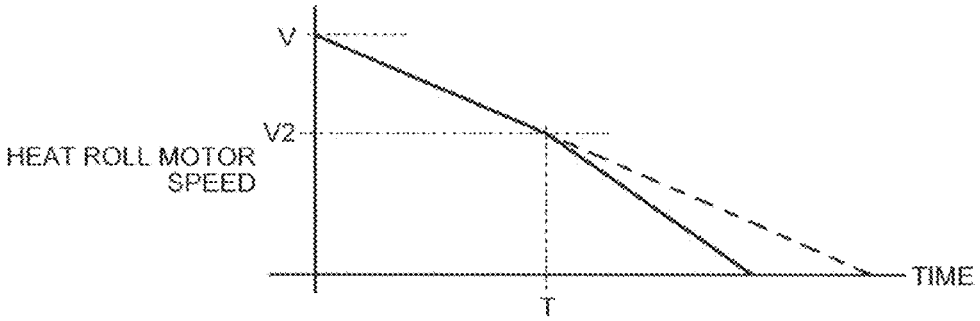
FIG. 7 is a view illustrating an example of a control executed by a fixing feeding control unit of the embodiment.

When it is assumed, for example, that threshold value PT=P1, it is not necessary for the fixing feeding control unit 112 to change the brake force (brake current) in the general purpose sheet even after the time T has passed. In contrast, in the coating sheet, since the threshold value becomes PT<P2, as illustrated in FIG. 7, the fixing feeding control unit 112 increases the brake force (brake current) after the time T has passed (a solid line and a broken line illustrate a case of a conventional control in which the brake force is not changed) and reduces the feed amount of the web W until the feed of the web W has been stopped.

Figure 8:
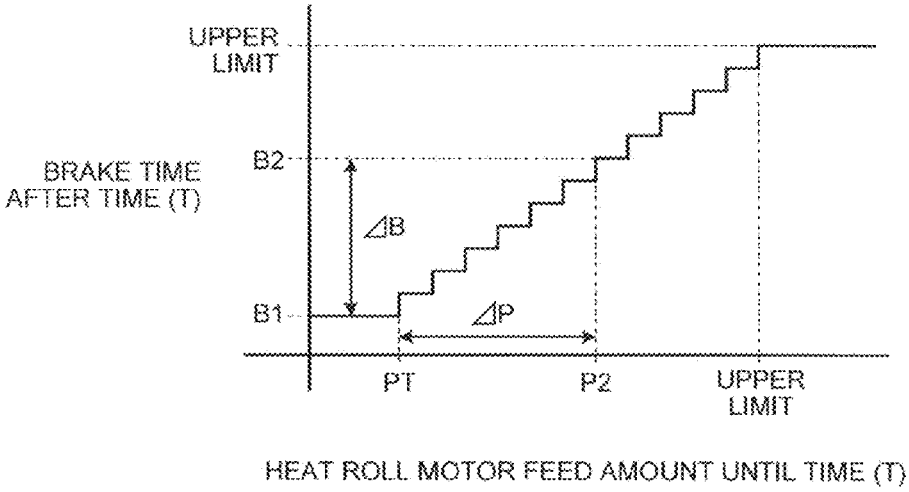
FIG. 8 is an explanatory view of an example of a determination method of brake force after a predetermined time which is determined by the fixing feeding control unit of the embodiment.

FIG. 8 is an explanatory view of an example of a determination method of the brake force by the fixing feeding control unit 112 of the embodiment after the time T passes. In the example illustrated in FIG. 8, although the fixing feeding control unit 112 controls the brake force by changing a brake time, the control method of the brake force is not limited thereto.

When the brake time that is periodically generated to the fixing feeding unit 13 until the time T has passed after the trigger for stopping the feed of the web W had occurred is illustrated by B1, the fixing feeding control unit 112 sets the brake time after the time T passes also to B1 when the number of pulses at the time T is equal to or less than the threshold value PT.

In contrast, when the number of pulses at the time T is P2 (P2>threshold value PT), the fixing feeding control unit 112 sets the brake time after the time T passed to B2 ($B2=B1+\Delta B$). That is, when the number of pulses at the time T has exceeded the threshold value PT, the fixing feeding control unit 112 increases a correction amount $\Delta B$ of the brake time in proportion to a difference value $\Delta P$ between the number of pulses and the threshold value PT.

However, when the brake time has been excessively increased, since there is a possibility that the heat roll motor 13*m* rotates backward and image quality is deteriorated in the fixing feeding unit 13, in the embodiment, an upper limit is set to the brake time. Accordingly, when the number of pulses at the time T has exceeded a predetermined value, the brake time is kept to the upper limit value.

The fixing feeding control unit 112 of the embodiment will be explained in more detail.

The fixing feeding control unit 112 causes the fixing feeding unit 13 to execute the first deceleration operation based on a first brake signal. Further, the fixing feeding control unit 112 creates a second brake signal based on the measured feed amount and causes the fixing feeding unit 13 to execute the second deceleration operation based on a synthesized brake signal created by synthesizing the first brake signal and the second brake signal.

Note that although it is assumed that the first brake signal and the second brake signal are output each time the encoder 13*e* outputs a predetermined number of pulses, the timings at which the first brake signal and the second brake signal are output are not limited thereto. Further, an output time of the second brake signal is longer than an output time of the first brake signal, and the fixing feeding control unit 112 causes the fixing feeding unit 13 to execute the first deceleration operation while the first brake signal is being output and causes the fixing feeding unit 13 to execute the second deceleration operation while the synthesized brake signal is being output. Further, when the feed amount is larger than the threshold value, although the output time of the second brake signal is made longer, the output time is equal to or less than an upper limit value.

Figure 9:
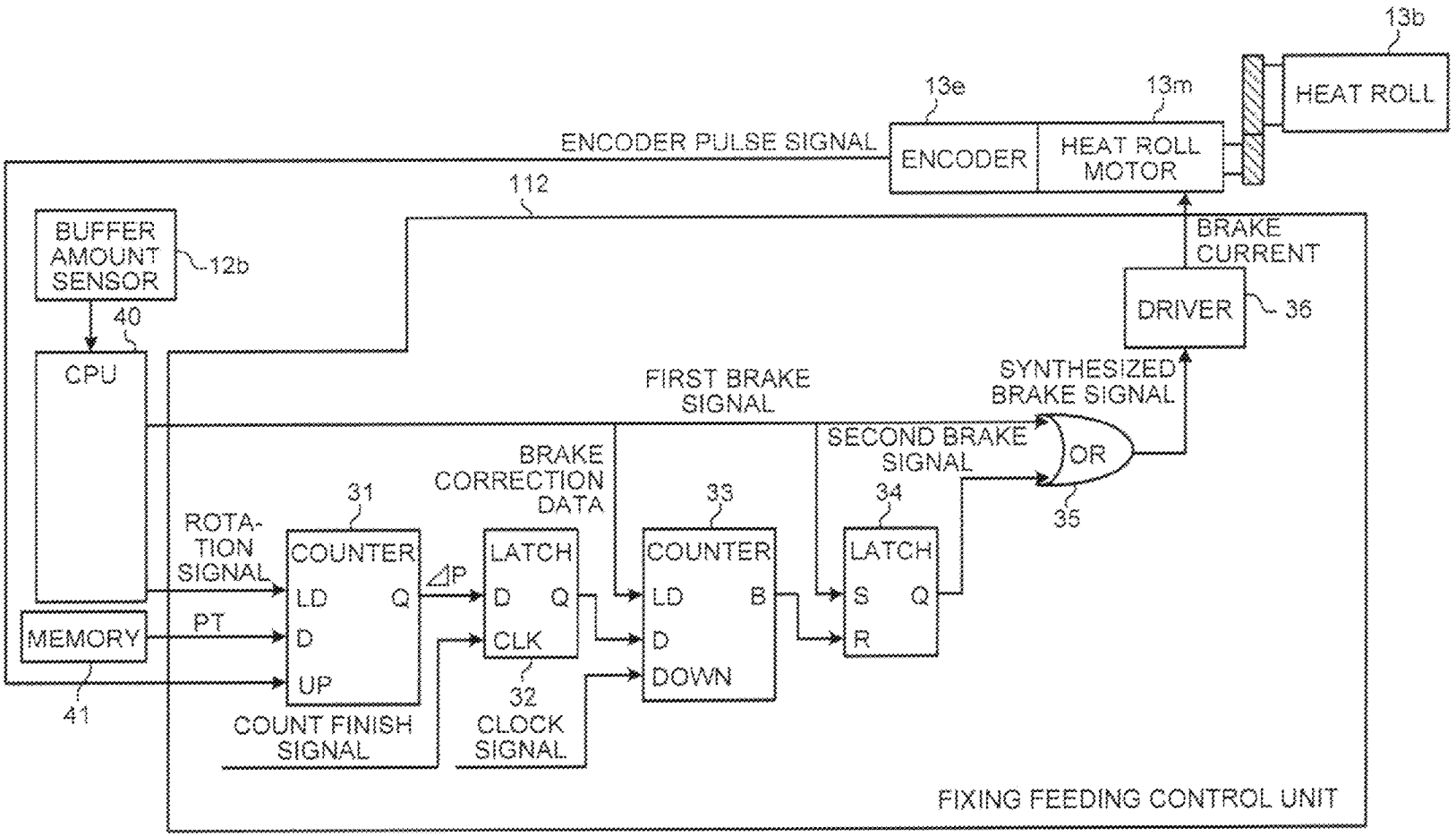
FIG. 9 is a circuit diagram illustrating an example of a circuit configuration of the fixing feeding control unit of the embodiment.
Figure 10:
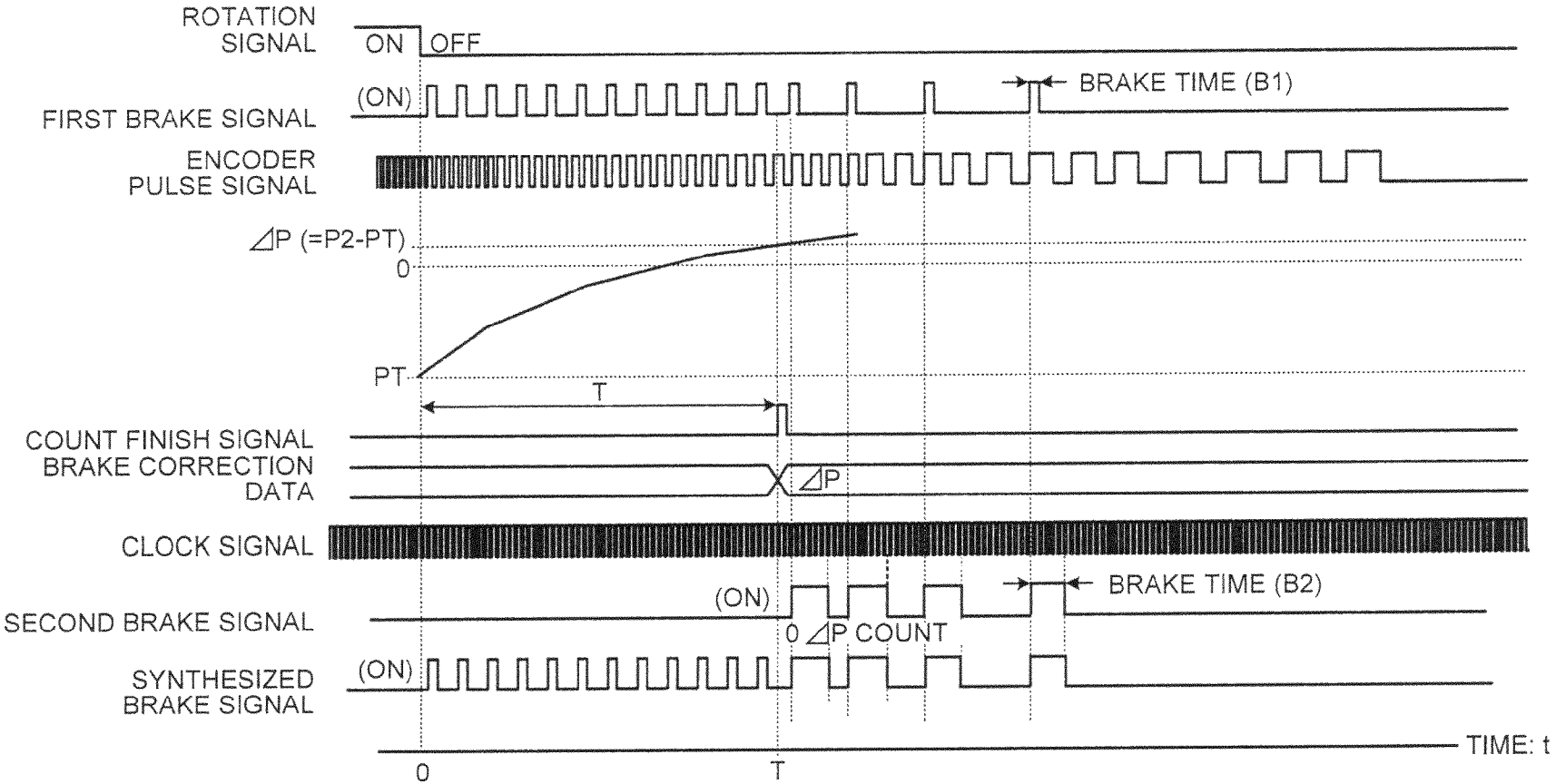
FIG. 10 is a timing chart diagram illustrating an example of a timing chart of the fixing feeding control unit of the embodiment.

FIG. 9 is a circuit diagram illustrating an example of a circuit configuration of the fixing feeding control unit 112 of the embodiment, and FIG. 10 is a timing chart illustrating an example of a timing chart of the fixing feeding control unit 112 of the embodiment. As illustrated in FIG. 9, the fixing feeding control unit 112 has a counter 31, a latch 32, a counter 33, a latch 34, an OR circuit 35, and a driver 36. Note that, in the embodiment, as illustrated in FIG. 9, the first brake signal that is used mainly is created by software, and the second brake signal that is used when an abrupt brake is applied is created by a hardware circuit because the second brake signal has the predetermined time T as short as, for example, about 50 ms (FIG. 6) and is required to execute a high speed process.

A CPU (Central Processing Unit) 40 outputs a rotation signal to the counter 31. Further, when the rotation signal has changed from an "H" level to an "L" level, the CPU 40 creates the first brake signal and outputs the first brake signal to the counter 33, the latch 34, and the OR circuit 35. With the operation, the printing apparatus P shifts from a print operation to a print stop operation, and the heat roll motor 13*m* which rotates at the constant speed starts a deceleration operation.

When the encoder 13*e* detects the rotation of the heat roll motor 13*m*, the encoder 13*e* outputs an encoder pulse signal to the counter 31.

When the rotation signal changes from the "H" level to the "L" level, the counter 31 loads the threshold value PT from a memory 41 and starts to count the number of pulses from the encoder pulse signal. The counter 31 outputs a difference value ΔP (ΔP=P2−PT) between the counted number of pulses P2 and the threshold value PT to the latch 32. When the difference value ΔP has exceeded an upper limit value, however, the counter 31 outputs the upper limit value to the latch 32 as the difference value ΔP.

When the time T has passed after the rotation signal changes to the "L" level, since a count finish signal that has been input to the latch 32 changes from the "L" level to the "H" level, the latch 32 latches the difference value ΔP input from the counter 31 and outputs the difference value ΔP to the counter 33 as brake correction data.

The counter 33 loads the brake correction data (the difference value ΔP) from the latch 32, and when the first brake signal has become the "H" level, the counter 33 counts down the brake correction data each time a clock signal is input, and when the brake correction data has become "0", the counter 33 makes a B output that has been output to the latch 34 to the "H" level.

The latch 34 outputs the second brake signal to the OR circuit 35, and when the first brake signal has become the "H" level, the latch 34 makes the second brake signal to the "H" level, and when the B output has become the "H" level, the latch 34 makes the second brake signal to the "L" level.

The OR circuit 35 ORs the first brake signal with the second brake signal to thereby create the synthesized brake signal by synthesizing the first brake signal and the second brake signal and outputs the synthesized brake signal to the driver 36.

While the synthesized brake signal is being made to the "H" level, the driver 36 causes the brake current to flow to the heat roll motor 13*m* and decelerates the feed of the web W.

As a result, the brake time until the time T becomes a time B1 at which the first brake signal becomes the "H" level, and the brake time after the time T becomes a time B2 at which the second brake signal becomes the "H" level.

Note that in an example illustrated in FIGS. 9 and 10, the fixing feeding control unit 112 changes the first brake signal to the "H" level each time the encoder pulse signal is detected three times, and when the first brake signal changes to the "H" level, the second brake signal is also changed to "H" level. However, this is only an example of an operation, and timing and a cycle at which the second brake signal is changed to the "H" level are not limited thereto.

As described above, according to the embodiment, since the fixing feeding unit 13 is caused to execute the second deceleration operation according to the feed amount of the web W achieved by the first deceleration operation, the feed amount of the web W when the feed of the web W fed by the fixing feeding unit 13 has been stopped becomes a predetermined amount regardless of the type of the web W, and thereby the angle of the buffer plate 12*a* can be fallen within the appropriate range. Thus, even if the web W is any of the coating sheet having the large degree of smoothness and the general purpose sheet, since the feed amount of the web W when the feed of the web W fed by the fixing feeding unit 13 has been stopped can be made to the predetermined amount, the angle of the buffer plate 12*a* can be fallen within the appropriate range.

Further, in the embodiment, the brake time is changed by creating the synthesized signal by synthesizing the first brake signal and the second brake signal, which is created by a circuit, instead of changing a cycle at which the first brake signal created by the CPU becomes the "H" level. Thus, according to the embodiment, the brake time can be corrected at a higher speed than the method of changing the cycle at which the first brake signal becomes the "H" level.

Modification

Note that the embodiment is not limited to the embodiment mentioned above and can be variously modified.

For example, in the embodiment, the brake time of the first brake signal (the cycle at which the first brake signal becomes the "H" level) may be changed according to the angle of the buffer plate 12*a* when the feed of the web W has been started by the fixing feeding unit 13. With the operation, a stop control of the heat roll motor 13*m* can be more accurately executed.

Further, when the printing apparatus P is, for example, a printing apparatus capable of switching two or more types of print speeds, the fixing feeding control unit 112 may use a threshold value according to a set print speed as the threshold value.

Figure 11:
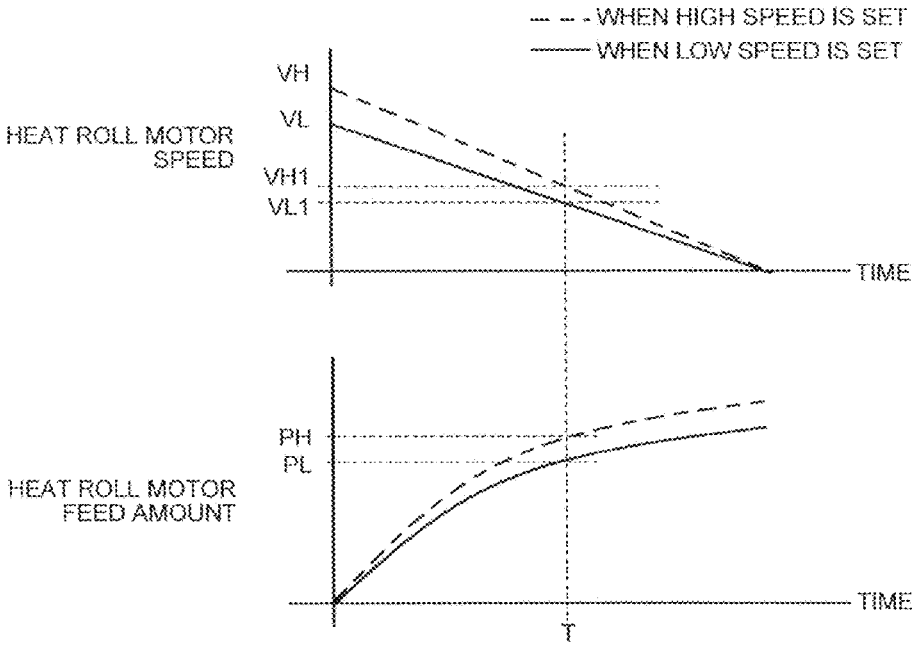
FIG. 11 is an explanatory view illustrating an example of a feed speed and a feed amount of the web fed by the fixing feeding unit at each feed speed when the feed of the web is stopped.

FIG. 11 is an explanatory view illustrating an example of the feed speed and the feed amount of the web W fed by the fixing feeding unit 13 at each feed speed when the feed of the web W has been stopped. In the example illustrated in FIG. 11, it is assumed that the web W is the general purpose sheet and the feed speed of the web W is set to a high speed and a low speed. Further, in the example illustrated in FIG. 11, it is assumed that although the brake force (brake current) generated to the fixing feeding unit 13 is not changed until the feed of the web W has been stopped, the brake force at the high speed is different from the brake force at the low speed so that the feed of the web W is stopped in the same time at any of the high speed and the low speed.

As illustrated in FIG. 11, it is assumed that the feed speed of the web W fed by the fixing feeding unit 13 (the heat roll motor 13*m*) when the trigger for stopping the feed of the web W has occurred is VH (inch/second) at the high speed and VL (inch/second) at the low speed. Further, it is assumed that, as a result that the fixing feeding control unit 112 causes the fixing feeding unit 13 to execute the deceleration operation (as a result that the brake force is generated), the feed speed of the web W at the time T is VH1 (inch/second) at the high speed and VL1 (inch/second) at the low speed. In the case, when the feed amount (inch) of the web W at the time T is converted to the number of pulses of the encoder, the number of pulses at the high speed is PH=P×((VH+VH1)/2)×T and the number of pulses at the low speed is PL=P×((VL+VL1)/2)×T.

As described above, even if the web W is the same, since the number of pulses is different at the high speed and at the low speed, in the modification, for example, a threshold value at the high speed is made to PTH (PTH=PH) and a threshold value at the low speed is made to PTL (PTL=PL). Note that the correction amount (ΔB/ΔP in FIG. 8) of the second brake signal can be also changed by switching the cycle of the clock signal at the high speed and at the low speed.

Further, as illustrated in FIG. 11, the feed amount of the web W when the feed of the web W has been stopped by the fixing feeding unit 13 becomes smaller at the low speed than at the high speed. Accordingly, when the deceleration of the heat roll motor 13*m* has been started at the low speed at the same timing as that at the high speed, the buffer plate 12*a* is stopped at a position higher than that at the high speed. Accordingly, actually, at the low speed, the CPU 40 delays the timing at which the rotation signal is changed to the "L" level than the timing at the high speed.

As described above, also in the printing apparatus capable of switching the two or more types of print speeds, since the feed amount of the web W when the feed of the web W fed by the fixing feeding unit 13 has been stopped can be made to the predetermined amount even if the web W is any of the coating sheet having the large degree of smoothness and the general purpose sheet, the angle of the buffer plate 12*a* can be fallen within the appropriate range.

Further, in the embodiment, although the fixing feeding unit 13 has been explained as the example of the second feeding unit, the second feeding unit is not limited thereto and may be any feeding mechanism for feeding the web (nip-feed) downstream of the printing unit 100 in a feed direction.

With the configuration, even if a mechanical configuration of a printing apparatus is a configuration such as the configuration disclosed in, for example, Japanese Patent Application Laid-open No. 2007-156315, that is, a configuration in which a web fed by a discharge roller and a pressing roller is fixed by non-contact fixing such as flash fixing and oven fix, the embodiment can be applied to the configuration. In the case, a feeding mechanism such as the discharge roller and pressing roll is preferably used as the second feeding unit.

Further, with the configuration, the embodiment can be applied even to an inkjet printing apparatus employing a mechanical configuration that is independently provided with a fixing mechanism and a feeding mechanism and to an inkjet printing apparatus employing a mechanical configuration that is not provided with a fixing mechanism.

Hardware Configuration

Figure 12:
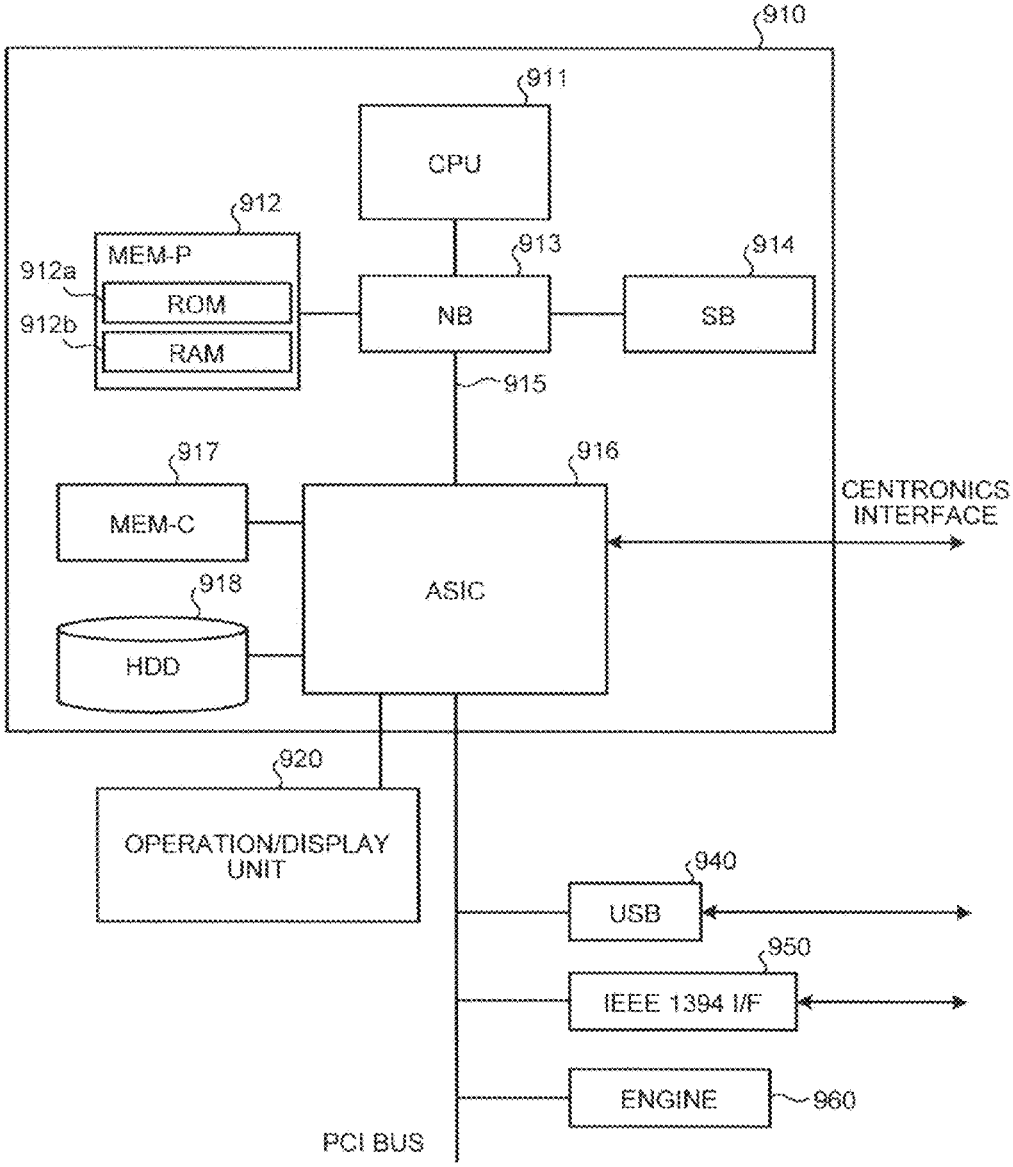
FIG. 12 is a block diagram illustrating an example of a hardware configuration of the printing apparatus of the embodiment and a modification.

FIG. 12 is a block diagram illustrating an example of a hardware configuration of the printing apparatus P of the embodiment and the modification.

As illustrated in FIG. 12, the printing apparatus P is configured such that a controller 910 is connected to an engine unit (Engine) 960 via a PCI (Peripheral Component Interconnect) bus. The controller 910 is a controller for controlling the printing apparatus P in its entirety, drawing, communication, and an input from an operation/display unit 920. The engine unit 960 is an engine capable of being connected to the PCI bus and is a printer engine, for example, a white/black plotter, a one-drum color plotter, or a four-drum color plotter. The engine unit 960 includes also an image processing section such as an error diffusion section and a gamma conversion section in addition to an engine section.

The controller 910 has a CPU 911, a north bridge (NB) 913, a system memory (MEM-P) 912, a south bridge (SB) 914, a local memory (MEM-C) 917, an ASIC (Application Specific Integrated Circuit) 916, and a hard disc drive (HDD) 918 and is configured such that an AGP (Accelerated Graphics Port) bus 915 connects between the north bridge (NB) 913 and the ASIC 916. In addition to the above-mentioned, the MEM-P 912 further includes a ROM 912*a* and a RAM 912*b*.

The CPU 911 controls the printing apparatus P in its entirety, has a chip set composed of the NB 913, the MEM-P 912, and the SB 914, and is connected to other equipment via the chip set.

The NB 913 is a bridge for connecting the CPU 911 and the MEM-P 912, the SB 914, and the AGP bus 915 and has a memory controller for controlling read and write operations from and to the MEM-P 912, a PCI master, and an AGP target.

The MEM-P 912 is a system memory used as a memory for storing a program and data, a memory for developing the program and the data, and a drawing memory of a printer and is composed of the ROM 912*a* and the RAM 912*b*. The ROM 912*a* is a memory dedicated for reading data and used as the memory for storing the program and the data, and the RAM 912*b* is a memory that can write and read data and is used as the memory for developing the program and the data and as the drawing memory of the printer.

The SB 914 is a bridge for connecting the NB 913 and a PCI device, and a peripheral device. The SB 914 is connected to the NB 913 via the PCI bus which is also connected with a network interface (I/F) section and the like.

The ASIC 916 is an IC (Integrated Circuit) that has a hardware element, is used to image processing, and has a role as a bridge for connecting the AGP bus 915, the PCI bus, the HDD 918, and the MEM-C 917, respectively. The ASIC 916 is composed of a PCI unit for transferring data between a PCI target and an AGP master, an arbiter (ARB) acting as a core of the ASIC 916, a memory controller for controlling the MEM-C 917, DMACs (Direct Memory Access Controllers) for turning image data by a hardware logic and the like, and the engine unit 960 via the PCI bus. The ASIC 916 is connected with a USB (Universal Serial Bus) 940 and an IEEE1394 (the Institute of Electrical and Electronics Engineers 1394) interface (I/F) 950 via the PCI bus. The operation/display unit 920 is directly connected to the ASIC 916.

The MEM-C 917 is a local memory used as an image buffer for copy and a code buffer, and the HDD 918 is a storage for storing image data, a program, font data, and a form.

The AGP bus 915 is a bus interface for a graphics accelerator card proposed to increase a speed of graphic processing and increases a speed of the graphics accelerator card by directly accessing the MEM-P 912 at a high throughput.

According to the embodiment, an angle of the buffer plate can be fallen within an appropriate range without depending on a type of the web is achieved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus, comprising:

a printing unit that forms an image on a web;

a first feeding unit that feeds the web in the printing unit;

a second feeding unit that feeds the web downstream of the printing unit in a feed direction;

a buffer unit that has a buffer plate and absorbs flexure of the web generated by a feed difference between the first feeding unit and the second feeding unit by operating the buffer plate;

a first feeding control unit that causes the first feeding unit to execute a deceleration operation for decelerating a feed speed of the web when a trigger for stopping the feed of the web has occurred; and a second feeding control unit that:

causes the second feeding unit to execute a first deceleration operation for decelerating the feed speed of the web when the trigger for stopping the feed of the web has occurred, measures, with a sensor, a feed amount of the web fed by the second feeding unit during a period beginning at a first time and until a predetermined time passes, and when the feed amount is larger than a threshold value, changes the first deceleration operation executed by the second feeding unit to a second deceleration operation based on the feed amount, wherein the second deceleration operation is an operation for decelerating the feed speed of the web more than the first deceleration operation.

2. The printing apparatus according to claim 1, wherein the second feeding control unit causes the seconding feed unit to execute the first deceleration operation based on a first brake signal, creates a second brake signal based on the feed amount, and causes the second feeding unit to execute the second deceleration operation based on a synthesized brake signal obtained by synthesizing the first brake signal and the second brake signal.

3. The printing apparatus according to claim 2, wherein the second feeding unit comprises a DC servo motor acting as a driving source for feeding the web; and the sensor, the sensor being an encoder for detecting a rotation of the DC servo motor and outputting a pulse; and the second feeding control unit measures a number of pulses output by the encoder as the feed amount of the web fed by the second feeding unit.

4. The printing apparatus according to claim 3, wherein the first brake signal and the second brake signal are output each time the encoder outputs a predetermined number of pulses.

5. The printing apparatus according to claim 4, wherein an output time of the second brake signal is longer than an output time of the first brake signal, and the second feeding control unit causes the second feeding unit to execute the first deceleration operation during a period in which the first brake signal is output, and causes the second feeding unit to execute the second deceleration operation during a period in which the synthesized brake signal is output.

6. The printing apparatus according to claim 5, wherein the more the feed amount is larger than the threshold value, the more an output time of the second brake signal becomes longer.

7. The printing apparatus according to claim 6, wherein the output time of the second brake signal is equal to or less than an upper limit value.

8. The printing apparatus according to claim 1, wherein the second feeding control unit uses a threshold value according to a set print speed as the threshold value.

9. A feeding control method executed in a printing apparatus, wherein the printing apparatus includes:

a printing unit that forms an image on a web;

a first feeding unit that feeds the web in the printing unit;

a second feeding unit that feeds the web downstream of the printing unit in a feed direction; and a buffer unit that has a buffer plate and absorbs flexure of the web generated by a feed difference between the first feeding unit and the second feeding unit by operating the buffer plate, the feeding control method comprising:

first feeding controlling that causes, when a trigger for stopping the feed of the web has occurred, by a first feeding control unit, the first feeding unit to execute a deceleration operation for decelerating a feed speed of the web; and a second feeding controlling including:

causing, when the trigger for stopping the feed of the web has occurred, by a second feeding control unit, the second feeding unit to execute a first deceleration operation for decelerating the feed speed of the web, measuring, with a sensor, a feed amount of the web fed by the second feeding unit during a period beginning at a first time and until a predetermined time passes, and changing, when the feed amount is larger than a threshold value, the first deceleration operation executed by the second feeding unit to a second deceleration operation based on the feed amount, wherein the second deceleration operation is an operation for decelerating the feed speed of the web more than the first deceleration operation.

* * * * *